United States Patent [19]

Ballweber et al.

[11] 4,217,425

[45] Aug. 12, 1980

[54] PAPER FIBER ADDITIVE CONTAINING POLYACRYLAMIDE BLENDED WITH GLYOXAL AND POLYMERIC DIALLYLDIMETHYL AMMONIUM CHLORIDE AS A CATIONIC REGULATOR

[75] Inventors: Edward G. Ballweber, Glenwood; Roger H. Jansma, Park Forest; Kenneth G. Phillips, River Forest, all of Ill.

[73] Assignee: Nalco Chemical Company, Oak Brook, Ill.

[21] Appl. No.: 957,952

[22] Filed: Nov. 6, 1978

[51] Int. Cl.[2] ..... D21D 3/00; D21H 3/52

[52] U.S. Cl. ..... 525/155; 162/166; 162/168 NA; 260/29.6 WB

[58] Field of Search ..... 260/874, 29.6 WB; 525/155; 162/166, 168 NA

[56] References Cited

U.S. PATENT DOCUMENTS 3,556,932 1/1971 Coscia ..... 162/166

*Primary Examiner*—Richard B. Turer

*Attorney, Agent, or Firm*—John G. Premo; Robert A. Miller; John S. Roberts

[57] ABSTRACT

A blend which contains homopolymers useful for imparting wet and dry strength to pulp and paper fibers which comprises a major amount of non-ionic polyacrylamide, together with glyoxal to impart crosslinking and polymeric diallyldimethyl ammonium chloride (DADMAC) as a cationic modifier. A buffer such as tetrasodium pyrophosphate may be used. A dosage of 0.2–5% by weight (preferred 0.5–2% by weight) based on the dry weight of fiber is utilized.

5 Claims, No Drawings

PAPER FIBER ADDITIVE CONTAINING POLYACRYLAMIDE BLENDED WITH GLYOXAL AND POLYMERIC DIALLYLDIMETHYL AMMONIUM CHLORIDE AS A CATIONIC REGULATOR

The present invention relates to an improved blend which contains homopolymers useful for imparting wet and dry strength to pulp and paper fibers which comprises a major amount of non-ionic polyacrylamide, together with glyoxal to impart crosslinking and polymeric diallyldimethyl ammonium chloride (DADMAC) as a cationic modifier. A buffer such as tetrasodium pyrophosphate may be used. A dosage of 0.2–5% by weight (preferred 0.5–2% by weight) based on the dry weight of fiber is utilized.

The present invention is an improved blend primarily of polymeric materials, namely, polyacrylamide and polyDADMAC wherein the aldehyde glyoxal is added as a crosslinking agent for the polyacrylamide and the function of DADMAC is as a cationic regulator. The polyacrylamide may be utilized from commercial materials in the form of crystalline powder and with a molecular weight of about 1,000 to 500,000. The polyacrylamide is non-ionic (cf. Davidson and Sittig, *Water Soluble Resins,* II, Van Nostrand-Reinhold, 1968, page 176) and retains its non-ionic character when utilized as a component of the present invention.

The glyoxal (CHOCHO) adds to the polyacrylamide during a base catalyzed reaction in two steps as follows.

The first reaction is the adduction of glyoxal on the acrylamide backbone:

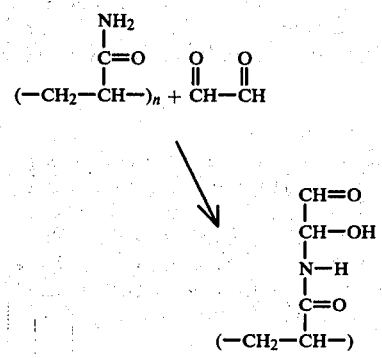

The second reaction involves the reaction of the second aldehyde with another polyacrylamide molecule.

The third component is polymeric diallyldimethyl ammonium chloride utilized as a cationic regulator and it is to be noted that the polymeric DADMAC does not react with the polymeric polyacrylamide in the blend.

A preferred composition for imparting wet and dry strength to paper fibers where the composition is utilized comprises:

40–95% by weight of polyacrylamide
4–14% by weight of polydiallyldimethyl ammonium chloride
2–50% by weight of glyoxal A preferred percentile is:

64–82% polyacrylamide by weight
4–14% polydiallyldimethyl ammonium chloride by weight
9–24% glyoxal by weight It has been found in using the material on fibers that a dosage of 0.2–5% (preferred 0.5–2%) of the composition is utilized based on dry weight of fiber. One additional optional component of the composition is tetrasodium pyrophosphate utilized as a buffer.

A specially preferred composition is as follows:

90 parts by weight of polyacrylamide
5–20 parts by weight of DADMAC
10–30 parts by weight glyoxal
20 parts of sodium pyrophosphate

PRIOR ART STATEMENT

U.S. Pat. No. 3,556,932 Coscia et al (American Cyanamid)—This patent deals with a glyoxalated acrylamide/DADMAC copolymer.

MIXING PROCEDURE

The polyacrylamide, glyoxal, DADMAC, and a buffer such as tetrasodium pyrophosphate were mixed in a solution which was slightly alkaline. The mixture was held at 40° C. as the viscosity built up in the alkaline milieu. After a period of time ranging from 180 minutes to 300 minutes, the crosslinking reaction was interrupted by a so-called acid kill, using $HNO_3$ or HCl to decrease the pH from about 7.2 to about 4.0. It has been found that a minimum viscosity necessary for use in the blend is about 17 cps (range 17–55 cps) and a preferred time of crosslinking reaction is about 360 minutes at 40° C. and 7.2–8.0 pH. Where other parameters are held constant, a crosslinking time of 180 minutes produced a viscosity of 10 cps and 240 minutes produced a viscosity of 11 cps. These viscosity readings proved insufficient to achieve the desired wet strength resin effect. It was further found that aging of 15–16 days after acid killing did not substantially affect the efficiency as a wet strength resin in fibers.

As to the pH milieu, since the crosslinking is rate increased in alkaline, a mixing pH of 9.5 may be utilized, which is subsequently neutralized to about 4.0 to "kill" the reaction.

COMPARATIVE EVALUATION

In comparison tests against two commercially utilized resins noted below, the blends according to this invention had salutary results where used in appropriate viscosity. These blends have shown improved results as to dry tensile and mullen strength tests over the two resins noted below. Additionally, improved results were noted against these same resins in dry tensile strength and dry strength mullen tests. The present blends were tested in viscosities ranging from 17–55 cps against (1) a glyoxalated acrylamide/DADMAC copolymer produced according to the teachings of U.S. Pat. No. 3,556,932 (Parez 631NC) and (2) polyamide/polyamine/epichlorohydrin produced according to U.S. Pat. No. 2,926,116 and 2,926,154 (Kymene 557H). The results of the comparison are set out in Example 1.

EXAMPLE I

TABLE 1

Resin Identification Evaluations

| Reference | Description | Viscosity | Age |
|---|---|---|---|
| B | Killed at 360 min. | 17 cps | 2, 3 days |
| C | Killed at 400 min. | 32 cps | 2, 3 days |
| D | Killed at 415 min. | 55 cps | 2, 3 days |
| A | Killed at 180 min. | 10 cps | 2, 3 days |
| E | Killed at 240 min. | 11 cps | 2, 3 days |
| F | Killed at 255 min. (pH 7.2) | 17 cps | 15, 16 days |

TABLE 1-continued

| Reference | Description | Viscosity | Age |
|---|---|---|---|
| | Resin Identification Evaluations | | |
| G | Killed at 300 min. (pH 7.2) | 48 cps | 15, 16 days |

TABLE 2

| Sample | 1 ΔM | 2 ΔM | 1A ΔDT | 3 ΔDT | 3A ΔDT | Viscosity |
|---|---|---|---|---|---|---|
| | Dry Strength as Evidenced by Dry Tensile and Mullen Burst Tests | | | | | |
| H | +8.8 | | 13.1 | 38.7 | 40.5 | |
| I | +8.6 | +8.1 | 22.9 | 10.5 | 7.8 | |
| B | +8.7 | +7.0 | 35.7 | 40.1 | 42.6 | 17 cps |
| C | +12.8 | +10.2 | 42.0 | 43.6 | 46.4 | 32 cps |
| D | +13.2 | +7.2 | 41.5 | 41.3 | 43.4 | 55 cps |
| A | −0.4 | +1.5 | 12.7 | 2.3 | 3.4 | 10 cps |
| E | +1.9 | +0.2 | 10.4 | 12.2 | 10.5 | 11 cps |

ΔM = increase of normalized mullen (over the blank)
ΔDT = percent improvement of dry tensile (over the blank)
H is a glyoxalated acrylamide/DADMAC copolymer (3,556,932)
I is polyamide/polyamine/epichlorohydrin (2,926,116; 2,926,154)

From the above it can be seen that in the samples of sufficient viscosity ranging from 17 cps–55 cps and denoted Samples B, C, D, both dry tensile and mullen burst tests results show a substantial advantage over commercial resins H and I.

TABLE 3

| | 1.9#/T WT | 1.9#/T ΔDT | 7.9#/T WT | 7.9#/T ΔDT | 15.8#/T WT | 15.8#/T ΔDT | Viscosity |
|---|---|---|---|---|---|---|---|
| | Wet and Dry Tensile Tests | | | | | | |
| H | 1.99 | 24.0 | 4.70 | 20.7 | 5.43 | 13.1 | |
| I | 2.38 | 26.3 | 5.40 | 22.7 | 5.77 | 22.9 | |
| F | 1.30 | 21.4 | 3.01 | 32.7 | 5.01 | 46.0 | 17 cps |
| D | | | | | 5.41 | 41.5 | 55 cps |
| C | | | | | 5.19 | 42.0 | 32 cps |
| B | | | | | 4.20 | 35.7 | 17 cps |
| E | | | | | 1.02 | 10.4 | 11 cps |
| A | | | | | 0.43 | 12.7 | 10 cps |

WT = normalized wet tensile
ΔDT = percent improvement of dry tensile (over the blank)
Blank dry tensile = 16.77

The interpretation of the results above shows a substantial advantage in dry tensile as evidenced by ΔDT over resins H and I at high and medium dosages.

TABLE 4

| | 1.9#/T | 7.9#/T | 15.8#/T | Viscosity |
|---|---|---|---|---|
| | Dry Strength (Mullen) Improvements | | | |
| Blank | (47.8) | | | |
| H | +4.1 | +9.2 | +8.8 | |
| I | +3.4 | +3.5 | +8.0 | |
| F | +4.2 | +5.7 | +9.2 | 17 cps |
| D | | | +13.2 | 55 cps |
| C | | | +12.8 | 32 cps |
| B | | | +8.7 | 17 cps |
| E | | | +1.9 | 11 cps |
| A | | | −0.4 | 10 cps |

Mullen tests above show substantial advantage of compositions of the present invention such as D and C at 15.8 lbs/T (0.8 wt. percent).

EXAMPLE II

Making the Composition

The compositions evaluated in all cases were (actives basis):

90 parts—polyacrylamide (intrinsic=0.49)
20 parts—sodium pyrophosphate buffer
10 parts—cationizer (DADMAC)
20 parts—glyoxal The first three ingredients were premixed with water sufficient to yield a final solids of 6% after glyoxal addition. The pH of this premix was adjusted to 9.5. Glyoxal was then added and the samples were observed for development of viscosity. At this point, the cross-linking was stopped by dilution and adjustment to neutral pH by acid.

Handsheets were prepared from bleached softwood kraft furnish and dosed with 20 lbs/T of actives. Wet strength testing was via immersion (Finch cup) for 10 seconds to provide "immediate" wet strength values.

The utilization of polyDADMAC as a cationizer in the reaction provided a clear cut case of non-reactivity with polyacrylamide and was the cationizer of choice.

EXAMPLE III

Procedure for Runs 1–10

Resin Preparation:

A mixture of polyacrylamide, polyDADMAC, tetrasodium pyrophosphate and water was prepared. To this was added glyoxal. The pH was immediately adjusted to 9.1 and the sample placed in a 25° C. water bath. At the indicated time, a sample was withdrawn for immediate testing.

Paper Preparation:

A sample of resin to yield 1% resin dosage based on fiber was mixed with a dilute paper fiber slurry (1%) and allowed to stand five minutes. The fiber slurry had previously been adjusted to pH 6.0. The fiber slurry was then used to prepare a handsheet on a Noble & Wood handsheet former. This paper was then dried by multiple passes on a drying drum held at 220° F.

Paper Testing:

After overnight equilibration, the papers were tested for wet and dry tensile strength. Wet tensile was determined by mounting the paper in the testing jaws, brushing water on the center portion of the strip and waiting 10 seconds before testing.

The absolute value of dry tensile was normalized for basis weight and compared to an untreated blank to obtain percent increase in dry tensile. The wet tensile value was similarly normalized and expressed as a percentage of the dry tensile value of that sheet.

TABLE 5

| | 1 | 2 | 3 | 4 | 5 | 6 | 7 | 8 | 9 | 10 | 11 | 12 |
|---|---|---|---|---|---|---|---|---|---|---|---|---|
| Parts polyacrylamide (solids) | 90 | 90 | 90 | 90 | 90 | 90 | 90 | 90 | 90 | 90 | | |
| Parts polyDADMAC (solids)* | 10 | 10 | 10 | 5 | 10 | 20 | 20 | 20 | 20 | 10 | | |
| Parts glyoxal (solids) | 10 | 20 | 30 | 30 | 30 | 30 | 30 | 30 | 30 | 20 | | |
| Parts tetrasodium pyrophosphate (solids) | 20 | 20 | 20 | 20 | 20 | 20 | 20 | 20 | 20 | 20 | | |
| Percent solids of mixture | 5.8 | 6.2 | 6.6 | 6.4 | 6.6 | 7.0 | 7.0 | 7.0 | 6.7 | 6.2 | — | — |

TABLE 5-continued

| | 1 | 2 | 3 | 4 | 5 | 6 | 7 | 8 | 9 | 10 | 11 | 12 |
|---|---|---|---|---|---|---|---|---|---|---|---|---|
| Polyacrylamide /η/ | 0.23 | 0.23 | 0.23 | 0.23 | 0.23 | 0.23 | 0.23 | 0.23 | 0.23 | 0.13 | — | — |
| PolyDADMAC /η/ | 0.44 | 0.44 | 0.44 | 0.44 | 0.44 | 0.44 | 0.44 | 0.70 | 1.03 | 0.44 | — | — |
| Time (minutes) | 205 | 120 | 60 | 90 | 60 | 60 | 70 | 70 | 70 | 180 | — | — |
| % increase in dry tensile | 36.5 | 25.8 | 42.1 | 43.2 | 44.5 | 53.3 | 50.6 | 56.6 | 51.4 | 29.3 | 43.7 | 18.5 |
| $\frac{\text{Wet tensile}}{\text{Dry tensile}}$ (100%)** | 16.6 | 22.2 | 20.6 | 22.5 | 21.9 | 23.1 | 21.9 | 25.1 | 22.2 | 16.4 | 22.7 | 15.7 |

*Each part of polyDADMAC solids has 0.36 parts of sodium chloride associated with it as a diluent.
**Blank is equal to zero.
No. 11 is a glyoxalated acrylamide/DADMAC copolymer.
No. 12 is polyamide/polyamine/epichlorohydrin.

TABLE 6

| | Conversion of Table 5 to Weight Percent | | | | | | | | | |
|---|---|---|---|---|---|---|---|---|---|---|
| | 1 | 2 | 3 | 4 | 5 | 6 | 7 | 8 | 9 | 10 |
| Polyacrylamide (solids) | 81.8 | 75.0 | 69.2 | 72.0 | 69.2 | 64.3 | 64.3 | 64.3 | 64.3 | 75.0 |
| PolyDADMAC (solids) | 9.1 | 8.3 | 7.7 | 4.0 | 7.7 | 14.3 | 14.3 | 14.3 | 14.3 | 8.3 |
| Glyoxal (solids) | 9.1 | 16.7 | 23.1 | 24.0 | 23.1 | 21.4 | 21.4 | 21.4 | 21.4 | 16.7 |
| | 100.0 | 100.0 | 100.0 | 100.0 | 100.0 | 100.0 | 100.0 | 100.0 | 100.0 | 100.0 |
| Tetrasodium pyrophosphate (based on above) | 18.2 | 16.7 | 15.4 | 16.0 | 15.4 | 14.3 | 14.3 | 14.3 | 14.3 | 16.7 |

EXAMPLE IV

The following mixture was prepared:

5.61% polyacrylamide (/η/=0.22)
1.26% polyDADMAC (/η/=0.7)
0.46% sodium chloride
1.86% glyoxal
1.24% $Na_2HPO_4$
0.18% $NaH_2PO_4.H_2O$
89.39% soft water The pH of the mixture was 7.0. The mixture was then placed in a 40° C. constant temperature bath for 400 minutes at which time the mixture was stabilized by adjustment to pH 4.0.

A 50/50 mixture of bleached hardwood kraft/-bleached softwood kraft was treated in the manner described in Example III. Testing was also similar.

| Product | Test Results: Increase in Dry Tensile | Test Results: $\frac{\text{Wet Tensile}}{\text{Dry Tensile}}$ (100%) |
|---|---|---|
| Example IV | 46.4% | 29.9% |
| Polyamide/polyamine/epichlorohydrin | 7.8% | 24.4% |
| Glyoxalated acrylamide/DADMAC copolymer | 40.5% | 33.0% |

What is claimed is:

1. A non-ionic water-soluble acrylamide homopolymer blend with glyoxal and containing polymeric diallyldimethyl ammonium chloride as a cationic regulator wherein the blend is utilized as a paper fiber additive and further wherein said blend is comprised of (1) polyacrylamide 40–95% by weight; (2) polydiallyldimethyl ammonium chloride 4–14% by weight; and (3) glyoxal 2–50% by weight, and which is utilized in a dosage of 0.2–5% based on dry weight of fiber.

2. The blend according to claim 1 which additionally contains tetrasodium pyrophosphate as a buffer.

3. The blend according to claims 1 or 2 which is utilized as a paper fiber additive in a dosage of 0.2–5% by weight based on the dry weight of fiber.

4. The composition of claim 1 wherein the polyacrylamide is 64–82%; the polydiallyldimethyl ammonium chloride is 4–14%; and glyoxal is 9–24%, all in weight percent.

5. A blend composition for imparting wet and dry strength to paper fibers which composition contains about 90 parts by weight of polyacrylamide; 5–20 parts by weight of polydiallyldimethyl ammonium chloride; 10–30 parts glyoxal; and 20 parts tetrasodium pyrophosphate.

* * * * *